US005501057A

United States Patent [19]

Dawson

[11] Patent Number: 5,501,057

[45] Date of Patent: Mar. 26, 1996

[54] UNIT MASONRY FENCE AND METHOD FOR ERECTING

[75] Inventor: John A. Dawson, Oakville, Canada

[73] Assignee: Canada Brick, Canada

[21] Appl. No.: 385,705

[22] Filed: Feb. 8, 1995

Related U.S. Application Data

[63] Continuation of Ser. No. 2,363, Jan. 6, 1993, abandoned.

[51] Int. Cl.[6] ..... E04H 17/14; E04G 21/00; E04C 2/40

[52] U.S. Cl. ..... 52/761; 52/297; 52/300; 52/474; 52/763; 52/779; 52/741.15; 52/745.1; 52/745.12; 256/19

[58] Field of Search ..... 52/284, 296, 297, 52/299, 300, 566, 611, 475.1, 777, 778, 779, 477, 474, 491, 761, 745.1, 745.12, 742, 741.15; 256/19, 13.1

[56] References Cited

U.S. PATENT DOCUMENTS

| | | | |
|---|---|---|---|
| 701,588 | 6/1902 | Liebau . | |
| 1,416,919 | 5/1922 | Wickson | 52/611 |
| 2,057,018 | 10/1936 | Dillon . | |
| 2,141,035 | 12/1938 | Daniels . | |
| 2,545,845 | 3/1951 | Du Batto . | |
| 2,658,379 | 11/1953 | Allen . | |
| 2,877,989 | 3/1959 | Brodersen . | |
| 3,239,194 | 3/1966 | Pike . | |
| 3,298,668 | 1/1967 | Schueren . | |
| 3,512,759 | 5/1970 | Resler . | |
| 3,855,752 | 12/1974 | Aylon . | |
| 3,902,702 | 9/1975 | Kinnaman . | |
| 4,364,546 | 12/1982 | Lyman . | |
| 4,726,567 | 2/1988 | Greenberg . | |
| 4,765,104 | 8/1988 | Boot . | |

FOREIGN PATENT DOCUMENTS

| | | | |
|---|---|---|---|
| 607539 | 8/1960 | Italy | 52/300 |

OTHER PUBLICATIONS

Brick Fences, *Masonary Advantage,* vol. 1, Issue I, Mar. 1989.

*Primary Examiner*—Michael Safavi
*Attorney, Agent, or Firm*—Parkhurst Wendel & Rossi

[57] ABSTRACT

A unit masonry fence and method for its installation. The unit masonry fence has footings, structurally rigid support posts extending upwardly from the footings and fence panels mounted over the support posts and supported by the footings. Each fence panel is made up of a beam extending generally the length of the panel and having a receptacle toward the ends thereof for receiving the support posts. A number of unit masonry courses are laid on the beam. The unit masonry courses terminate at each end with a pilaster made from pilaster masonry units laid integrally. The pilaster masonry units have a main body portion broader than the adjacent unit masonry courses and an opening extending through the body portion for receiving the support posts. The method of installing the unit masonry fence includes the steps of: pouring concrete footings at predetermined spacings, incorporating at least one upwardly extending support post in each of the footings and placing a unit masonry fence panel as described above on the footings with the support posts extending into the receptacles in the pilasters and base supporting member.

20 Claims, 7 Drawing Sheets

UNIT MASONRY FENCE AND METHOD FOR ERECTING

This is a Continuation of application Ser. No. 08/002,363 filed Jan. 6, 1993, now abandoned.

FIELD OF THE INVENTION

The present invention relates to unit masonry fences and more particularly to a fence made up of masonry fence panels which are prefabricated and installed as modular units.

BACKGROUND OF THE INVENTION

The term "masonry unit" is used herein to refer to burnt clay bricks, concrete bricks, blocks and analogous structural elements used in masonry structures.

Unit masonry fences made from building bricks or blocks have many desirable attributes. Masonry fences are rugged, have excellent noise attenuation capabilities, are aestheticlly pleasing and are very durable.

Traditionally unit masonry fences have been built in situ where they are to be used. Traditional methods for manufacturing a unit masonry fence are quite labour intensive and time consuming. Typically the location where the fence is to be erected would have to be graded and a suitable foundation poured. Next masonry components such as brick and mortar would have to be brought to the location and a skilled bricklayer employed to ensure that the masonry units are laid in straight and even courses.

As a unit masonry fence is generally tall and long for its width, some measures should be taken to ensure that the fence will not topple when subjected to lateral forces such as wind loads. This may be achieved by embedding reinforcing rods into the foundation, with the reinforcing rods extending upwardly through the masonry units.

An object of the present invention is to provide a unit masonry fence made up of fence panels which may be prefabricated and installed as modules yet which give the appearance of an in situ laid unit masonry fence.

A further object of the present invention is to enable the installation of a unit masonry fence without having to first pour a full foundation for the bottom course of masonry units.

SUMMARY OF THE INVENTION

A unit masonry fence comprising footings; support posts extending upwardly from the footings; and fence panels mounted over the support posts and supported by the footings, each fence panel including a beam extending generally the length of the panel and having a receptacle toward the ends thereof for receiving the support posts; a plurality of unit masonry courses laid on the beam with the unit masonry courses having a pilaster at each end, the pilasters being made from pilaster masonry units laid integrally with the unit masonry courses, each pilaster masonry unit having a main body portion broader than the adjacent unit masonry courses and a receptacle in the body portion for receiving the support posts.

A unit masonry fence panel comprising: a beam extending generally the length of the panel and having a receptacle toward the ends thereof for receiving support posts; a plurality of unit masonry courses laid on the beam with the unit masonry courses having a pilaster at each end, the pilaster being made from pilaster masonry units laid integrally with the unit masonry courses, each pilaster masonry unit having a main body portion broader than the adjacent unit masonry courses and a receptacle in the body portion for receiving support posts.

A method for installing a unit masonry fence includes the steps of:

(a) pouring concrete footings at predetermined spacings;

(b) incorporating at least one upwardly extending support post in each of the footings;

(c) placing a unit masonry fence panel as described above on the footings with the support posts extending into the receptacles in the pilasters and beam.

A pilaster masonry unit for a unit masonry fence, the pilaster masonry unit comprising a body portion having generally parallel upper and lower faces and a receptacle in the body portion between the upper and lower faces.

BRIEF DESCRIPTION OF THE DRAWINGS

The present invention is more fully described below with reference to the accompanying drawings in which.

DETAILED DESCRIPTION OF THE INVENTION

Figure 1:
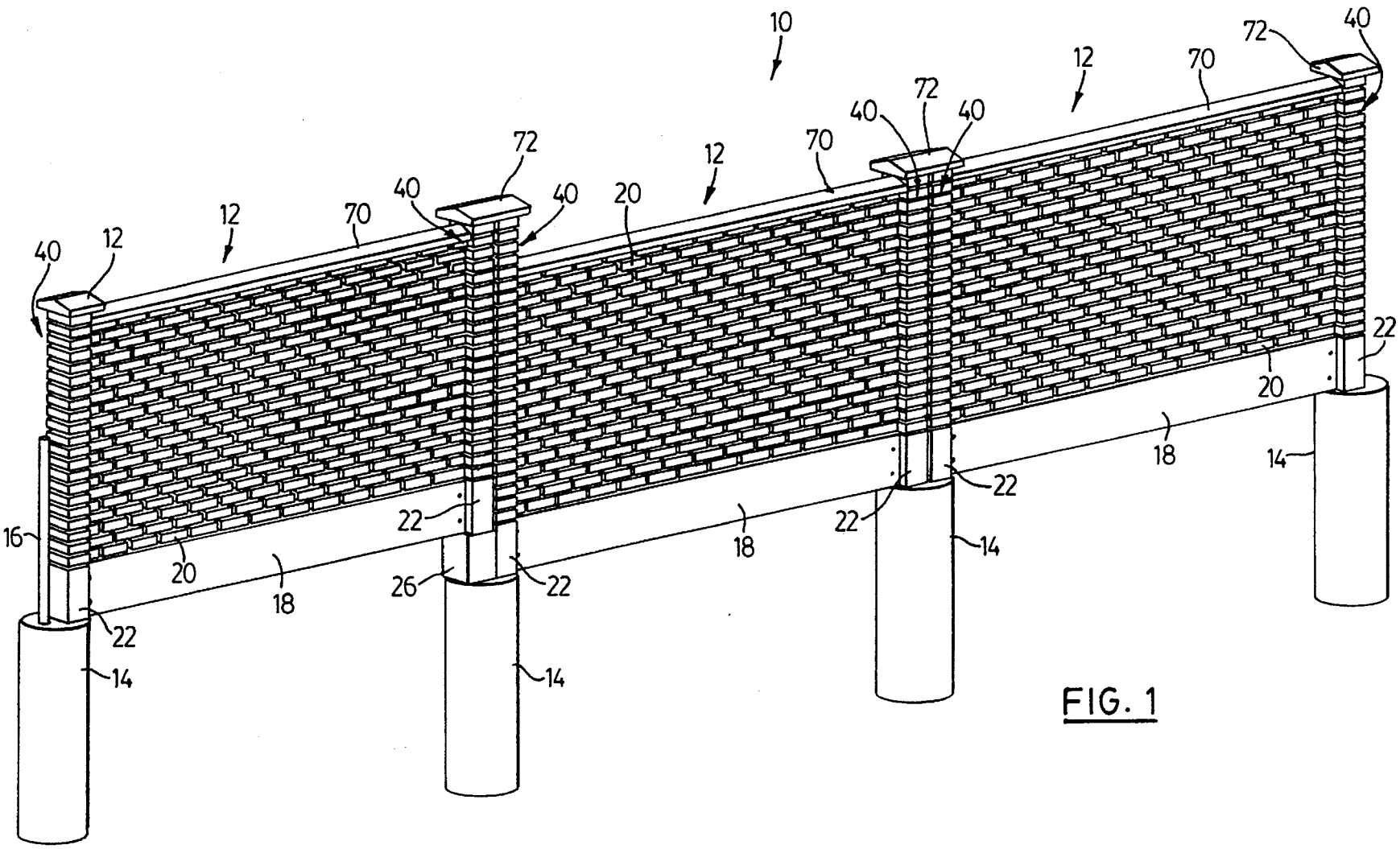
FIG. 1 is an isometric view of a unit masonry fence according to the present invention.
Figure 2:
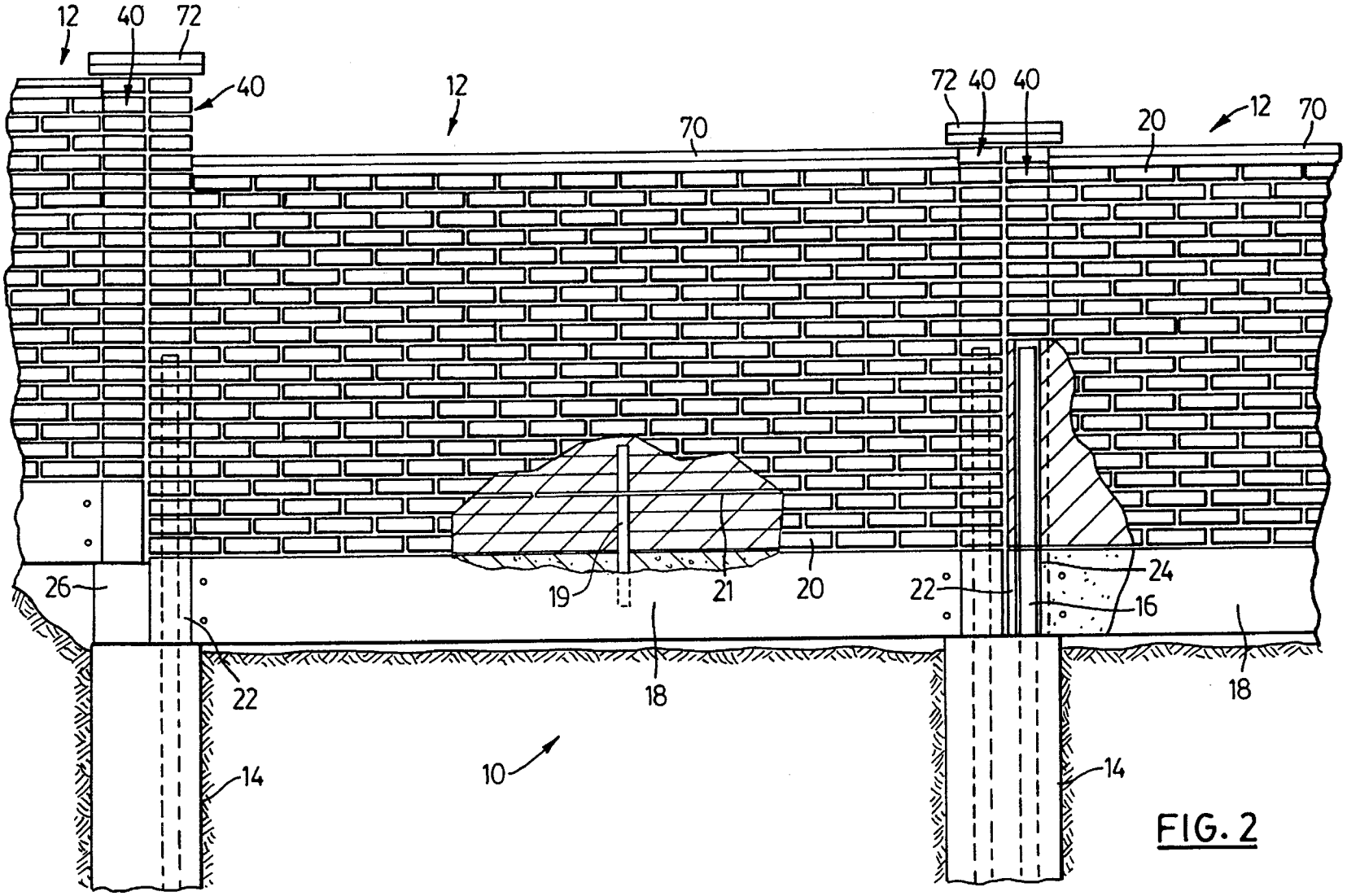
FIG. 2 is a front plan view, partially cut away, of a section of a unit masonry fence according to the present invention.

A unit masonry fence according to the present invention is generally indicated by reference 10 in FIGS. 1 and 2. The unit masonry fence 10 is made up of fence panels 12 supported on generally cylindrical footings 14. In erecting the fence, the footings 14 would typically be poured from concrete at a spacing generally corresponding to the span of the fence panels 12. Each of the footings 14 has, extending upwardly therefrom, support posts 16. The support posts 16 may be of tubular steel and may be incorporated in the footings 14 when the footings 14 are poured. The support posts 16 may extend to the full height of the fence panels 12.

Each of the fence panels 12 includes a base supporting member 18 at its bottom on which are laid a number of courses of masonry 20. The beam 18 may be made from precast concrete which may be optionally prestressed or post tensioned. Possibly the beam may be a pre-stressed or post tensioned masonry unit. The beam may also have reinforcing bars 19 embedded in it and extending into preferablly at least the first four lower masonry courses 20. Horizontal reinforcement of the masonry courses may be provided by incorporating reinforcing members such as indicated by reference 21 in the mortar between adjacent courses of masonry 20 at suitable course intervals such as every fourth course or as required.

The beams 18 are broader at their respective opposite ends 22. The broader ends 22 incorporate a receptacle such as the opening 24 extending vertically therethrough as shown in FIG. 2. Each receptacle 24 permits the beam 18 to be placed over the support posts 16 when the fence panels 12 are placed onto the footings 14.

In the unit masonry fences shown in FIGS. 1 and 2, the fence panels 12 toward the left hand side of the drawing are slightly higher than the adjacent panels 12. Such placement would typically be done where the underlying surface is irregular necessitating that the panels 12 be mounted at different heights. A supporting block 26 may be placed beneath the right hand end of the left hand fence panel 12 in order to compensate for the distance between the top of the corresponding footing 14 and the bottom of the end 22 which is at the right of the beam 18 of the leftmost fence panel 12 shown in FIGS. 1 and 2. Alternatively, the top of the footing 14 may be formed into a step of appropriate height.

Figure 3:
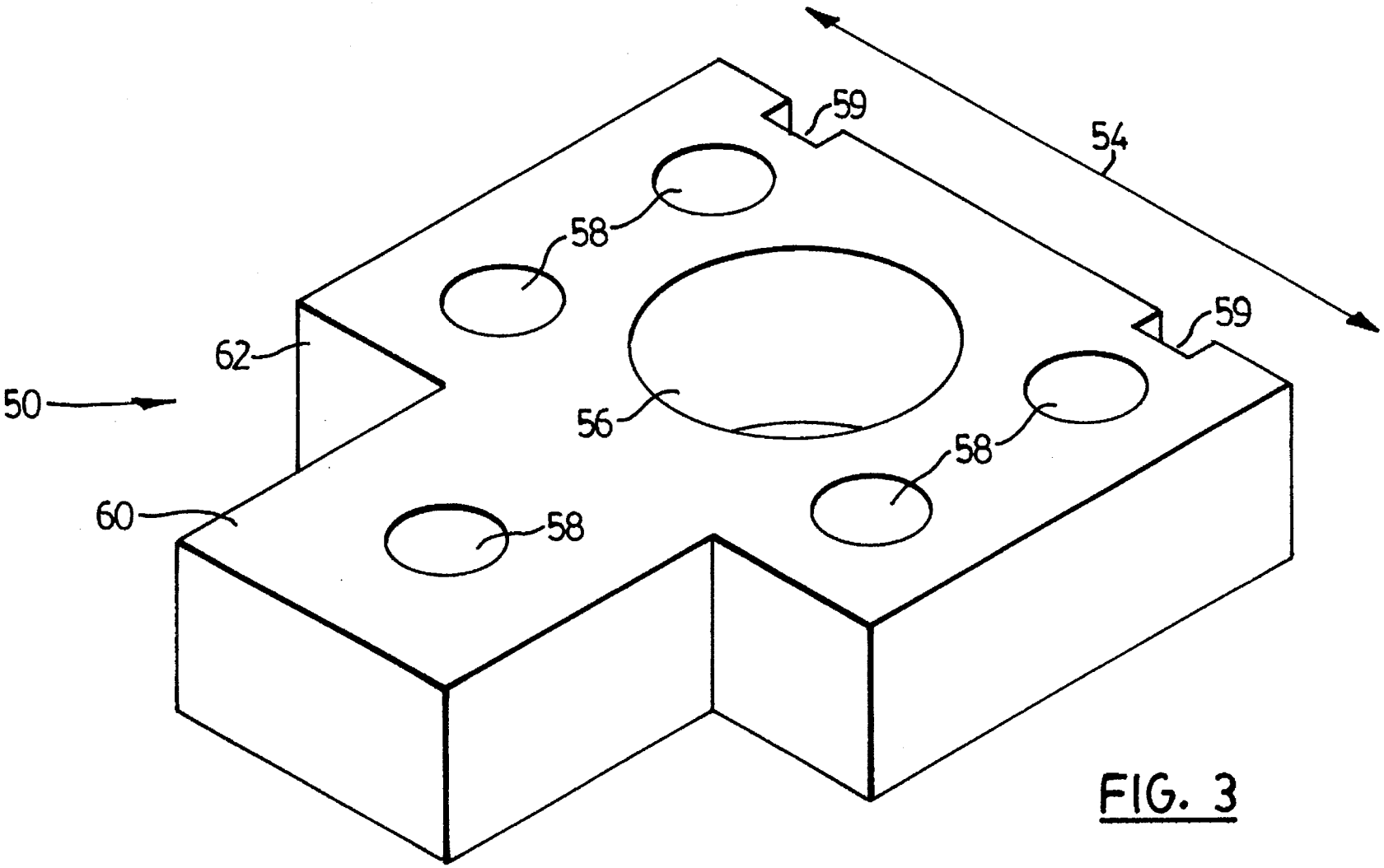
FIG. 3 is an isometric view of a pilaster masonry unit used in the unit masonry fence of the present invention.

Opposite ends of the fence panels 12 terminate in pilasters 40. The pilasters 40 are formed from pilaster masonry units such as those illustrated in FIGS. 3, 4, 5, 6 and 7 and generally identified by reference 50. The pilaster masonry units 50 have a body portion 52 which is broader in the dimension indicated by reference 54 than the adjacent unit masonry courses 20 in FIGS. 1 and 2. The main body portion 52 of the pilaster masonry unit 50 shown in FIGS. 3, 4 and 5 includes a receptacle in the form of an opening 56 extending generally vertically therethrough. The openings 56 receive the support posts 16 when the fence panels 12 are mounted on the footings 14.

Figure 7:
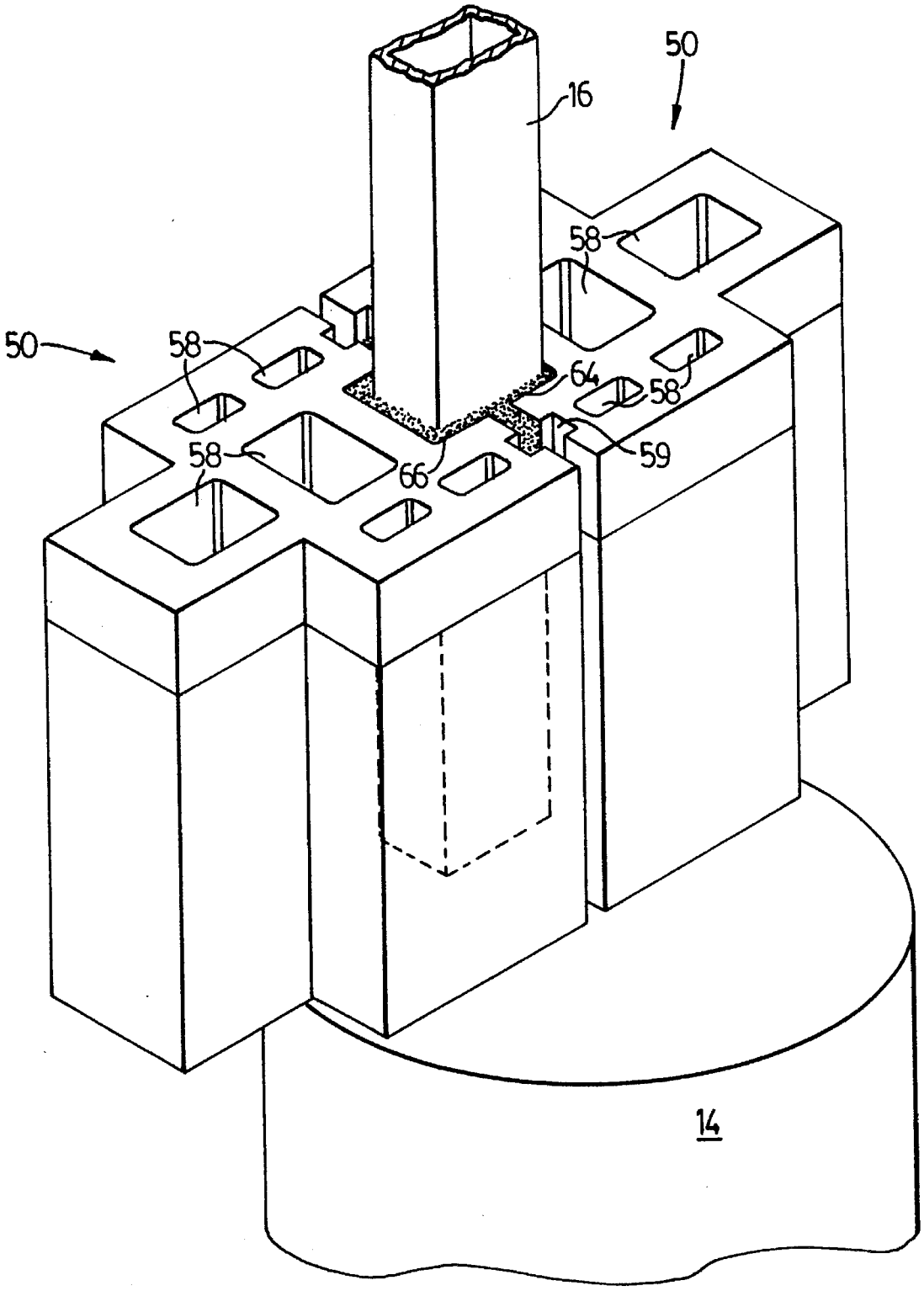
FIG. 7 is an isometric view of yet another embodiment of a pilaster masonry unit according to the present invention.

As shown in FIG. 7, the receptacle 56 does not have to be in the form of an opening extending through the pilaster masonry unit 50, but may alternatively be in the form of a recess 64 extending into a face of the unit to partially define an opening for receiving a support post 16. In the embodiment illustrated in FIG. 7, a pair of pilaster masonry units would be used, one on either side of the support post 60 with the respective receptacles 56 facing to define an opening for receiving the support post 60. Any space between the pilaster masonry units 50 and between the receptacle 56 and the pilaster masonry units 50 may be filled with mortar or grout as shown at reference 66. A similarly configured receptacle 24 may be used at the ends 22 of the beams 18.

Figure 6:
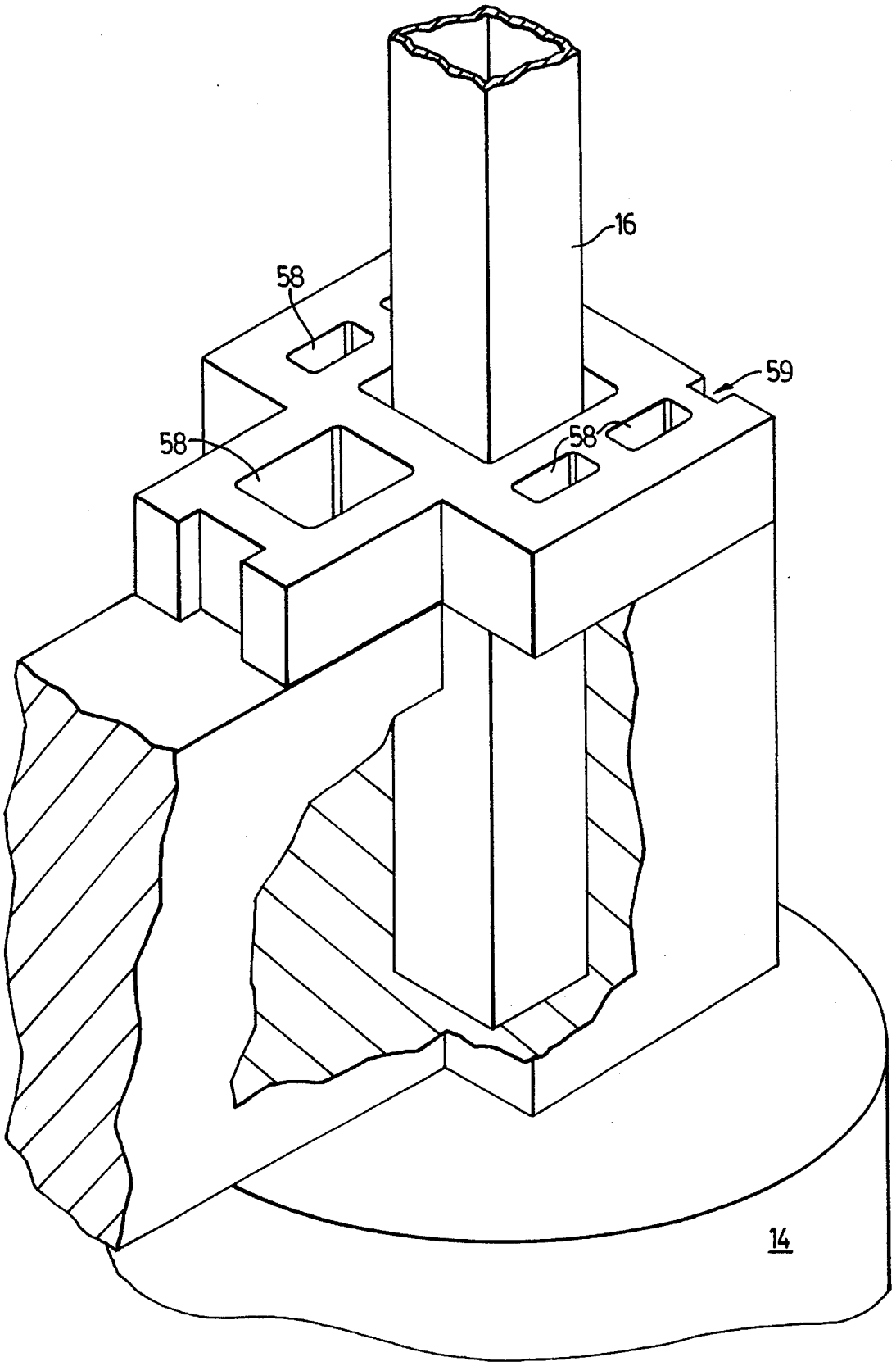
FIG. 6 is an isometric view of another embodiment of a pilaster masonry unit according to the present invention.

Although the main body portions 52 of the pilaster masonry unit 50 illustrated in the drawings are of a generally rectangular cross section, this is not a strict requirement and other cross sections may be used if preferred. Similarly, although the receptacles 56 through the pilaster masonry units 50 are shown as being generally cylindrical, other shapes may be used, for example if square cross section steel tubing were used for support posts as shown in FIGS. 6 and 7.

The pilaster masonry units illustrated in FIGS. 3, 4, 5, 6 and 7 may include further openings or cores 58 extending therethrough generally parallel to the receptacles 56. The cores 58 would be formed as part of the pilaster masonry units when the pilaster masonry units are manufactured. The cores reduce the amount of material in the pilaster masonry units to reduce weight, facilitate processing and improve product quality.

The pilaster masonry units 50 illustrated in FIGS. 3, 5, 6 and 7 include a generally rectangular portion 60 extending from a side 62 of the pilaster masonry units 50. The rectangular portion 60 is approximately the size and shape of a half length of a masonry unit. The rectangular portion 60 improves the appearance of the finished fence panels 12 and also more securely integrates the pilaster masonry units 50 into the fence panels 12 as described below.

Figure 4:
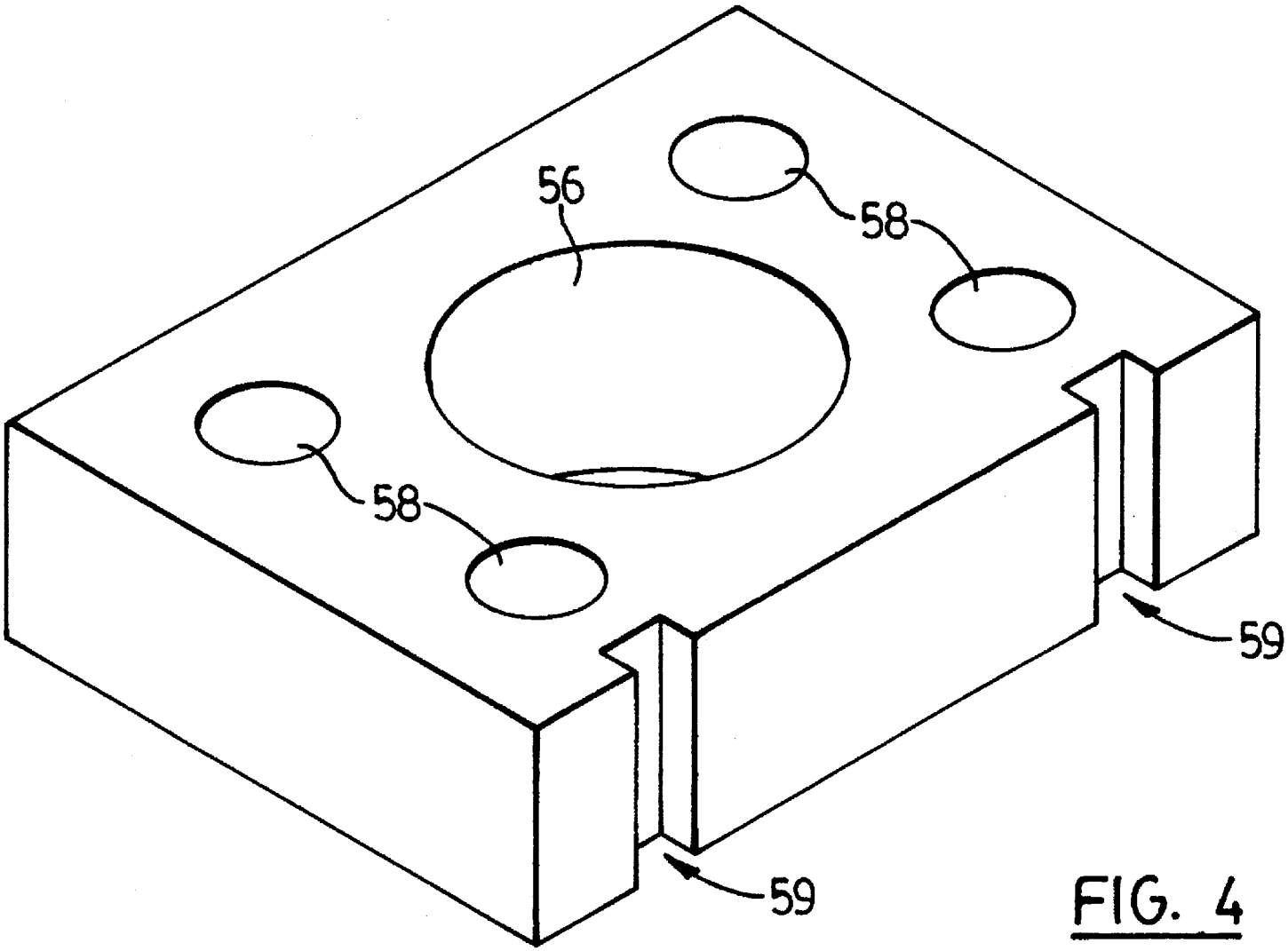
FIG. 4 is an isometric view of another pilaster masonry unit according to the present invention.
Figure 5:
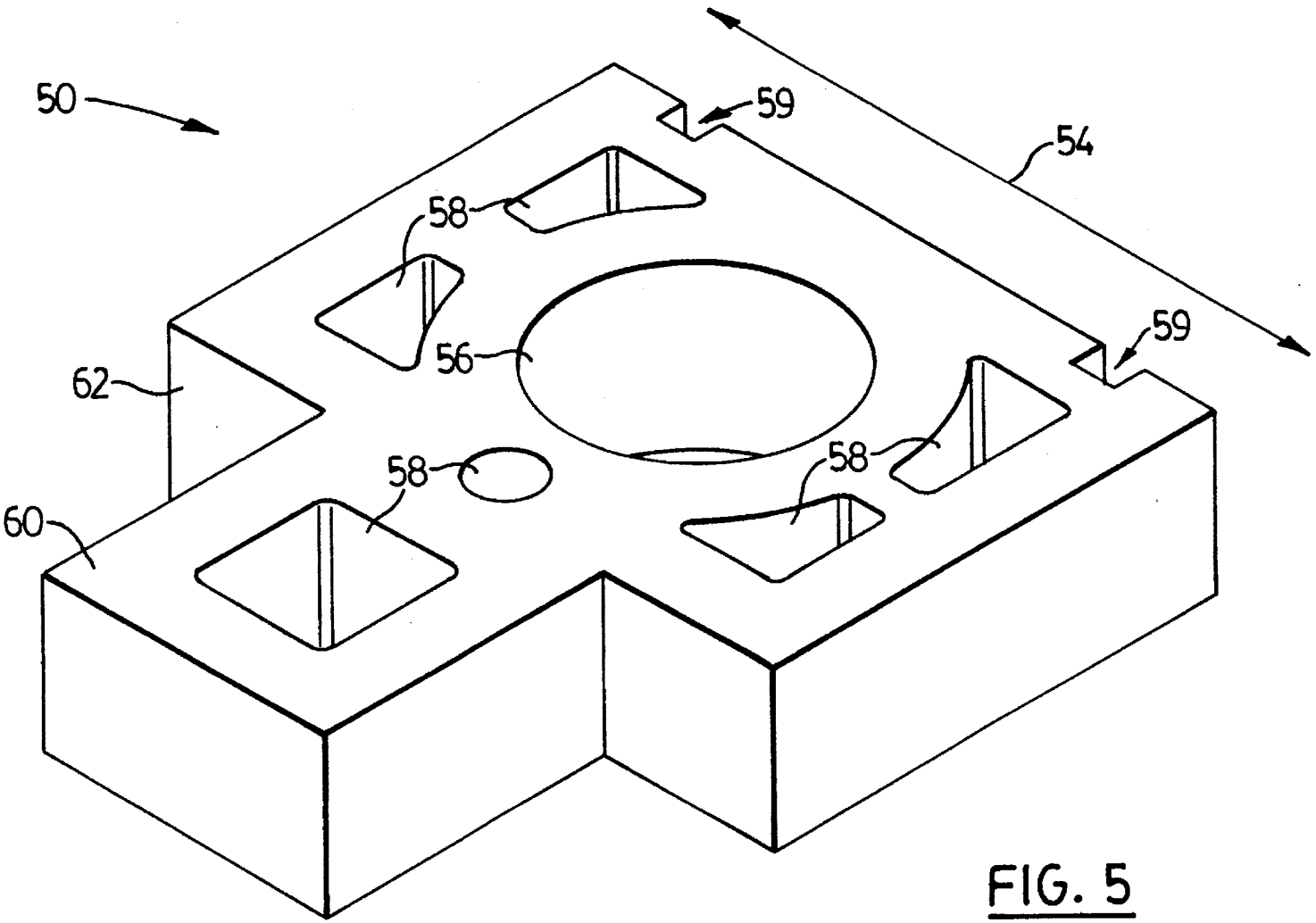
FIG. 5 is an isometric view of a further embodiment of a pilaster masonry unit according to the present invention.

Unit masonry courses are frequently laid in running bond with the vertical joints of each course placed approximately midway along the lengths of the underlying bricks. Accordingly, the ends of the unit masonry courses are staggered with alternate courses extending approximately one half masonry unit further out than the immediately adjacent courses. To incorporate the pilaster masonry unit 50 of the present invention into the fence panels 12, a pilaster masonry unit 50 having an extension 60 as shown in FIGS. 3, 5, 6 and 7 would be alternated with pilaster masonry units 50 not having an extension as shown in FIG. 4. The extension 60 would extend into the recess at the end of the unit masonry courses resulting from the bond as noted above. The pilaster masonry units 50 as illustrated in FIG. 4 which don't have an extension 60 would be used adjacent the unit masonry courses which extend as a result of the bond.

The receptacles 56 in the pilaster masonry units 50 and the receptacles 24 in the ends 22 of the beams 18 would generally be somewhat larger than the support posts 16. This reduces the need for great precision in lining up the openings so as to admit the support posts 16 and also allows some leeway in the spacing between support posts 16. Once the fence panels 20 have been mounted over the support posts 16, there is a space 64 between the support posts 16 and the openings 56 and 24 which may be filled with a grouting material 66 which will harden to firmly secure the fence panels over the support posts 16. The support posts 16 serve to locate the fence panels 12, provide resistance to bending and shear and also serve to reinforce the masonry.

The pilaster masonry units 50 may also be provided with vertical grooves 59 in one of the broader faces. The vertical grooves 59 of adjacent pilaster masonry units 50 face each other as shown in FIG. 7. The opposed vertical grooves 59 enable a thin strip of wood or plastic (not shown) to be inserted therein to contain the grout 66.

The fence panels 12 may also include a top member 70 overlying the uppermost of the unit masonry courses 20. The top member 17 may be of concrete or any suitable material such as a metal flashing, stone, brick or block. The top member 70 provides a finished appearance and prevents moisture or debris from entering the unit masonry courses 20 from the top. The top member 12 may be installed either at the time that the panels 20 are manufactured or once the panels 12 have been mounted.

Once the panels 12 have been mounted, the tops of the pilasters 40 may be covered with respective caps 72 secured over the tops by any suitable means such as mortar or mechanical affixation.

An advantage to the unit masonry fence of the present invention arises from the use of a base supporting member 18. The beam 18 provides adequate structural strength to enable the fence panels 12 to be transported and installed as modular units rather than having to be built in situ. Furthermore, it may be more efficient from a production standpoint to manufacture fence panels 12 in an environment specifically adapted to the manufacture of such fence panels rather than bringing all of the materials on site. Such advantages may be realized through the use of custom tooling to locate the masonry units in straight, parallel courses. Furthermore premanufacturing the panels 12 alleviates any problems which might arise from trying to construct a unit masonry fence in situ in inclement weather.

Another advantage of the unit masonry fence of the present invention which also arises from the use of a beam is that the fence may be mounted on footings 14 rather than requiring a full foundation underlying all of the bottom masonry course. As there is considerably less effort in pouring footings than in constructing a full foundation, there is an attendant cost and time saving.

It is of course necessary to ensure that the dimensions of the beam and the material of its construction are selected so as to provide adequate structural strength. As suggested above, precast concrete or optionally prestressed or post tensioned precast concrete may be used.

A further advantage of the present invention is that it provides a prefabricated unit masonry panel having a pleasing appearance on both sides, an advantage which would not be realized if the units were placed in a box-like supporting structure.

It is intended that the above description be interpreted in an illustrative rather than a restrictive sense as variations may be apparent to those skilled in the art without departing from the spirit or scope of the invention which is defined in the claims set out below.

I claim:

1. A partially prefabricated masonry fence comprising:

at least two footings spaced apart from one another;

structurally rigid support posts extending upwardly from said footings; and at least one prefabricated fence panel unit mounted over said support posts and supported by said footings, said fence panel unit comprising a base support beam extending substantially throughout the length of said panel for supporting said panel, said base support beam having a receptacle near each end region thereof for receiving said support posts, wherein only said end regions contact said footings;

said fence panel unit further comprising a plurality of courses of masonry units laid on said support beam, wherein each masonry unit has a length less than the length of said base support beam.

2. The partially prefabricated masonry fence of claim 1, wherein said fence panel unit further comprises a pilaster at each end thereof, said pilaster including a plurality of pilaster masonry units laid integrally with said plurality of courses of masonry units.

3. The partially prefabricated masonry fence of claim 2, wherein each said pilaster masonry unit comprises a main body portion broader than said adjacent unit masonry courses and a receptacle in said main body portion for receiving said support posts.

4. The partially prefabricated masonry fence of claim 3, wherein said base support beam consists essentially of concrete, the uppermost of said unit masonry courses is covered by a top member extending between said pilasters, and the tops of said pilasters are covered by respective caps.

5. The partially prefabricated masonry fence of claim 4, wherein said top member and said caps comprise at least one material selected from the group consisting of concrete, metal, stone, brick and block.

6. The partially prefabricated masonry fence of claim 1, wherein said base support beam consists essentially of pre-cast concrete.

7. The partially prefabricated masonry fence of claim 1, wherein said base support beam comprises at least one material selected from the group consisting of pre-cast concrete, pre-stressed concrete, and post tensioned concrete.

8. The partially prefabricated masonry fence of claim 1, wherein said structurally rigid support posts are tubular steel.

9. The partially prefabricated masonry fence of claim 3, wherein said support posts are tubular steel, and are dimensionally smaller than said receptacles in said pilaster masonry units and said base support beam to leave a space between said support posts and said receptacles.

10. The partially prefabricated fence of claim 1, wherein said at least two footings include a plurality of footings spaced apart from each other, and a prefabricated fence panel unit is supported by each pair of adjacent footings.

11. A prefabricated fence panel unit to be installed on at least two spaced apart footings, said panel unit comprising:

a base support beam extending substantially throughout the length of said panel unit and having a receptacle near each end region thereof for receiving at least one generally vertically extending structurally rigid support post;

a plurality of courses of masonry units laid upon said base support beam; and a pilaster at each end of said fence panel unit, said pilaster including a plurality of pilaster masonry units laid integrally with said plurality of courses of masonry units, each said pilaster masonry unit having a main body portion broader than said courses of masonry units and at least some of said pilaster masonry units having a receptacle in said main body portion for receiving said support post.

12. The prefabricated masonry fence panel unit of claim 11, wherein said base support beam consists essentially of pre-cast concrete.

13. The prefabricated masonry fence panel unit of claim 11, wherein said base support beam comprises at least one material selected from the group consisting of pre-cast concrete, pre-stressed concrete, and post tensioned concrete.

14. The prefabricated masonry fence panel unit of claim 11, further comprising a top member extending along and covering the uppermost face of said unit masonry courses.

15. The prefabricated masonry fence panel unit of claim 11, further comprising a top member of at least one material selected from the group consisting of concrete, metal, stone brick and block, extending along and covering the uppermost face of said unit masonry courses.

16. A method of installing a masonry fence including a plurality of masonry fence panel units prefabricated off-site, wherein each fence panel unit includes a base support beam extending substantially throughout the length of the fence panel unit and having a receptacle near each end region thereof, and each fence panel unit further includes a plurality of courses of masonry units laid upon the base support beam, said method comprising performing the following steps on-site:

a) pouring at least two concrete footings spaced apart from one another;

b) incorporating at least one generally vertically extending structurally rigid support post in each said footing;

c) lifting the fence panel units above said support posts to align the receptacles of each fence panel unit with said support posts; and d) lowering each fence panel unit onto said footings such that at least one of said support posts is received in each receptacle formed in each fence panel unit.

17. The method of claim 16 wherein each fence panel unit further comprises a pilaster at each end thereof, said pilaster including a plurality of pilaster masonry units laid integrally with said plurality of courses of masonry units, each said pilaster masonry unit having a main body portion broader than said unit masonry courses and at least some of said pilaster masonry units having a receptacle in said main body portion for receiving said support post.

18. The method of claim 16, wherein said fence panel unit is installed by placing only the end regions of said base support beam on said footings.

19. The method of claim 16, further comprising the steps of:

d) filling any space between said support posts and said receptacles with grout; and e) securing a cap over said pilasters.

20. The method of claim 19, further comprising the step of covering the upper face of the top course of said unit masonry courses with a top member extending along said top course between said pilasters.

* * * * *